US006659137B2

(12) United States Patent
Imasaki et al.

(10) Patent No.: US 6,659,137 B2
(45) Date of Patent: Dec. 9, 2003

(54) TWO-LAYER CLAD PIPE

(75) Inventors: Katsuhiro Imasaki, Kyoto (JP); Hiroyuki Furukawa, Kyoto (JP); Toshitsugu Ookubo, Kyoto (JP); Sadao Oiko, Kyoto (JP)

(73) Assignee: Suncall Corporation, Kyoto (JP)

( * ) Notice: Subject to any disclaimer, the term of this patent is extended or adjusted under 35 U.S.C. 154(b) by 83 days.

(21) Appl. No.: 09/881,571

(22) Filed: Jun. 14, 2001

(65) Prior Publication Data

US 2002/0008133 A1 Jan. 24, 2002

(30) Foreign Application Priority Data

Jun. 14, 2000 (JP) ..... 2000-178439

(51) Int. Cl.[7] ..... F16L 9/14
(52) U.S. Cl. ..... 138/142; 138/143
(58) Field of Search ..... 138/143, 142

(56) References Cited

U.S. PATENT DOCUMENTS 798,056 A * 8/1905 Nicholson ..... 138/142
2,311,138 A * 2/1943 Swartz ..... 138/151
2,516,689 A * 7/1950 France et al. ..... 138/143
3,598,156 A * 8/1971 Ulmer et al. ..... 138/143
4,217,886 A * 8/1980 McLaughlin ..... 138/137
4,346,739 A * 8/1982 Asada ..... 138/143
4,556,240 A * 12/1985 Yoshida ..... 285/55
4,784,311 A * 11/1988 Sugao ..... 138/142
5,265,793 A * 11/1993 Usui et al. ..... 138/143
5,887,628 A * 3/1999 Usui ..... 138/142
6,070,618 A * 6/2000 Iwabuchi ..... 138/143

* cited by examiner

*Primary Examiner*—James Hook
(74) *Attorney, Agent, or Firm*—Darby & Darby

(57) ABSTRACT

An outer pipe 10 and an inner pipe 12 are formed by drawing. Inner pipe 12 is inserted into outer pipe 10 and a metal core 14 is inserted into inner pipe 12. From this state, drawing is performed so that outer pipe 10 presses tightly against inner pipe 12. Metal core 14 is pulled out, resulting in a two-layer clad pipe 15. Alternatively, a two-layer clad pipe can also be made by drawing outer pipe 10 and inner pipe 12 without inserting metal core 14.

2 Claims, 5 Drawing Sheets

TWO-LAYER CLAD PIPE

BACKGROUND OF THE INVENTION

The present invention relates to a two-layer clad pipe and a method for making the same. More specifically, the present invention relates to a two-layer clad pipe with an outer pipe outwardly fitted to an inner pipe and a method for making the same. A "two-layer clad pipe" is different from a two-layer pipe where there is a gap between the inner pipe and the outer pipe. What is referred to is a pipe in which the outside of the inner pipe is covered by the outer pipe and the two pipes are pressed integrally against each other.

Conventional metal pipes are generally single-layer structures since they are usually made with drawing operations. While pipes in which a synthetic resin film layer is formed on the inner surface of a metallic outer pipe are used in practice, metallic two-layer pipes are currently not available.

Conventional metal piper are also formed by creating of holes at the center of metal rods, by drilling using machine tools such as drill presses. While drills, capable of drilling small-diameter holes of 100–300 microns, are available, these drills are limited to forming holes with a depth of about three times the drill diameter. Thus, drilling is not able to provide a cylindrical through-hole. Also, while drawing can be performed to shape pipes in various irregular, non-circular shapes, it is almost impossible to form small-diameter pipes with small holes of no more than approximately 1 mm diameter.

An optical communication system structure has optical connectors connected to the ends of multiple optical fibers and optical connectors connected to each other through optical adapters. In these conventional optical communication systems, a connection ferrule is mounted at the end of each optical fiber, and an alignment sleeve is disposed in the optical adapter. A connection is made by inserting a pair of connection ferrules into the ends of an alignment sleeve, and the end surfaces of the cladding of the optical fibers are abutted against each other.

Referring to FIGS. 18(*a*) and 18(*b*), a connection ferrule 50 is formed from a main ferrule unit 51 and a zirconia cylinder 52. A core guiding hole 53 (e.g., 800 microns inner diameter, 2.5 mm length) is formed in main ferrule unit 51 to guide the core of an optical fiber. A cladding guiding hole 56 (e.g., 125 microns inner diameter, 5 mm length) is formed in cylinder 52 to guide the cladding of the optical fiber. A fitting section 54 is formed on main ferrule unit 51 to fit the fitting hole of the optical connector.

With pipes having a single-layer structure, everything from the inside to the surface of the pipe is formed from the same metal. Thus, these pipes are not suitable for cases where different functions are demanded for the inner surface and the outer surface of the pipe. For example, there are cases where the inner surface and the outer surface of a pipe should have different corrosion resistance, strength, conductivity, magnetism, wear characteristics, heat characteristics, ease of cutting, specific density, or the like. However, pipes with single-layer structures are not able to meet these needs. For example, for pipes carrying corrosive fluids, the entire pipe would be made from a corrosion-resistant metal. Thus, the specifications for the outer surface of the pipe would be needlessly high, resulting in increased production costs for the devices and equipment.

Also, with pipes made using conventional drawing operations involving dies and plugs, the inner diameter cannot be less than 1 mm. No suitable technology has been established for producing small- diameter pipes. As a result, production of ring-shaped or cylindrical precision metal pipes from pipes is difficult. Also, while holes with irregular cross-sections can be formed in pipes through drawing, these holes formed by drawing can be slightly larger or smaller than the plug diameter, making it difficult to improve the precision of the hole.

Referring to FIGS. 18(*a*) and 18(*b*), a thin hole with an inner diameter of approximately 125 microns cannot be formed in a metal member, so the connection ferrule must be formed from a main ferrule unit and a separate cylinder, making the connection ferrule very expensive.

OBJECTS AND SUMMARY OF THE INVENTION

It is an object of the present invention to provide a two-layer clad pipe which overcome the foregoing problems.

More specifically, it is an object of the present invention to provide a two-layer clad pipe in which the inner surface and the outer surface are formed from metals suited for their required functions.

Another object of the present invention is to provide a two-layer clad pipe that can be used in various applications.

Yet another object of the present invention is to provide a method for making a two- layer clad pipes.

A two-layer clad pipe according to the present invention includes a metal inner pipe and an outer pipe outwardly fitted tightly against an outer perimeter surface of the inner pipe. The outer pipe is formed from a metal different from a metal used to form the inner pipe.

Since the inner pipe and the outer pipe in this two-layer clad pipe are formed from different metals, the inner pipe and the outer pipe can be formed with metals suited for their respectively required functions.

There are no restrictions on the diameter of the inner pipe, and various sizes can be provided. Similarly, there are no restrictions on the diameter of the outer pipe, and various sizes can be provided. The inner pipe can have thin walls or thick walls. Similarly, the outer pipe can have thin walls or thick walls. There are no particular restrictions on the diameter of the hole in the inner pipe, and various diameters can be used. The cross-section shape of the outer pipe is not restricted to a circular shape and non-circular irregular shapes can be used. The metals used in the inner pipe and the outer pipe can be selected from steel, stainless steel, copper and alloys thereof, aluminum and alloys thereof, titanium and alloys thereof, magnesium and alloys thereof, and the like. However, the inner pipe and the outer pipe must be formed from metals that can be shaped by drawing.

For example, a two-layer clad pipe with a stainless steel inner pipe and a standard steel outer pipe will have a corrosion-resistant inner surface and can be used for various applications. A two-layer clad pipe having an aluminum inner pipe and a stainless steel outer pipe with relatively thin walls will have a corrosion-resistant outer surface and will be light, allowing it to be used for various applications.

A method for making a two-layer clad pipe according to the present invention includes a first step for producing a metal outer pipe by drawing and producing an inner pipe by drawing. The inner pipe is formed from a metal different from that used in the outer pipe. A second step involves inserting the inner pipe into the outer pipe and inserting a metal core into the inner pipe. A third step involves drawing the outer pipe and the inner pipe with the inserted metal core so that the inner pipe is pressed tightly against the metal core and the outer pipe is pressed tightly against an outer perimeter surface of the inner pipe. A fourth step involves pulling out the metal core from the inner pipe.

By drawing the pipes with the metal core inserted, shaping is performed without the plug of the drawing device, using a die only. This provides an increased degree of freedom in shaping, and allows two-layer clad pipes having different cross-section shapes to be produced. The metal core can be used repeatedly. The diameter, thickness, metals, and cross-section shapes of the inner pipe and the outer pipe are the same as with the two-layer clad pipe.

Since the two-layer clad pipe is made by drawing, the inner pipe and the outer pipe with the inner pipe inserted into the outer pipe, and the metal core inserted in the inner pipe, the outer pipe can be tightly pressed against the inner pipe and the outer pipe can be tightly pressed against the metal core. Thus, the inner pipe and the outer pipe are pressed suitably tightly against each other, providing a high-quality pipe.

Since the metal core is pulled out after the drawing operation, the metal core allows the two-layer clad pipe to be formed with a hole having the same cross-section shape as the metal core. The cross-section shape of the metal core does not have to be circular and can be various non-circular irregular shapes. The thickness (diameter) of the metal core can be selected freely within the restriction imposed by the diameter of the inner pipe. For example, a thin metal core having a diameter of about 100 microns can be used.

Another method for making a two-layer clad pipe according to the present invention includes a first step for producing a metal outer pipe by drawing and producing an inner pipe by drawing. The inner pipe is formed from a metal different from that used in the outer pipe. A second step involves inserting the inner pipe into the outer pipe. A third step involves drawing the outer pipe and the inner pipe with the inner pipe inserted into the outer pipe so that the outer pipe is pressed tightly against an outer perimeter surface of the inner pipe. The diameter, thickness, metals, and cross-section shapes of the inner pipe and the outer pipe are the same as with the two-layer clad pipe.

In this invention, the inner pipe and the outer pipe are drawn without the use of a metal core. In the first step, the inner pipe and the outer pipe are formed by drawing. The inner pipe and the outer pipe are formed using different metals. In the second step, the inner pipe is inserted into the outer pipe. Next, in the third step, outer pipe and the inner pipe are drawn with the inner pipe inserted in the outer pipe. This causes the outer pipe to be pressed tightly against the outer perimeter surface of the inner pipe, thus providing a two-layer clad pipe.

Since this invention does not use a metal core, costs involved in inserting, storing, and transporting the metal core are eliminated. Drawing without the metal core is suitable for when the diameter of the hole in the two-layer clad pipe is approximately 1 mm or more.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 18 (*b*) is a side-view drawing of the connection ferrule.

DETAILED DESCRIPTION OF THE INVENTION

Referring to the figures, the following is a description of the embodiments of the present invention. In this embodiment, the present invention is implemented for a method for making composite ferrules mounted at the ends of optical fibers to provide optical fiber connections. First, composite ferrules and optical fibers used with them will be described.

Figure 1:
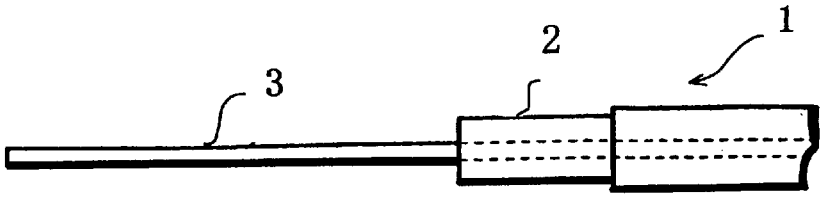
FIG. 1 is a drawing showing an exterior view of an optical fiber end according to an embodiment of the present invention.

Referring to FIG. 1, to allow a ferrule to support an end of an optical fiber 1, the end of optical fiber 1 is formed with, for example, a core 2, having a length of 2.5 mm and an outer diameter of approximately 800 microns, and a cladding 3, extending from the end of core 2 and having a length of 5 mm and an outer diameter of approximately 125 microns. The center of cladding 3 is formed with a core having a diameter of 9 microns or the like.

Figure 11:
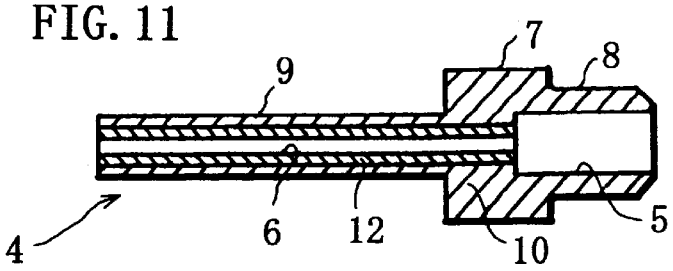
FIG. 11 is a cross-section drawing of a composite ferrule.
Figure 12:
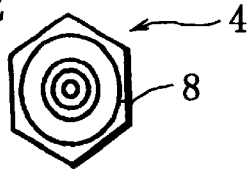
FIG. 12 is a side-view drawing as seen from the right of a composite ferrule.
Figure 13:
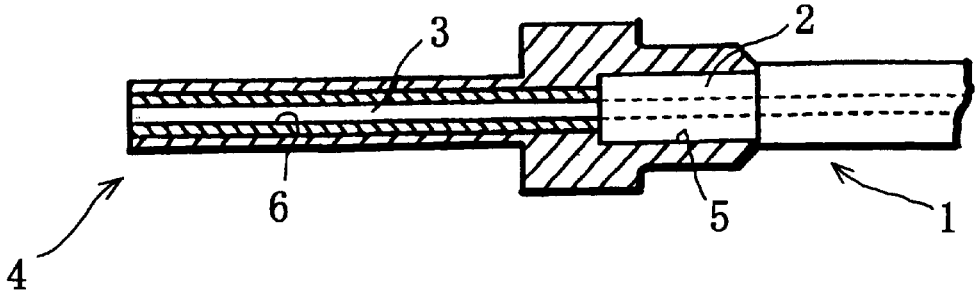
FIG. 13 is a cross-section drawing of a composite ferrule and an optical fiber end.

Referring to FIGS. 11 through 13, a composite ferrule 4 is an integrated, composite structure with an outer pipe 10 and an inner pipe 12 formed from stainless steel that is resistant to corrosion and easily cut. The following elements are formed at the center of composite ferrule 4: a core guide hole 5, capable of guiding core 2 of optical fiber 1, and a cladding guide hole 6. Core guide hole 5 can be formed, for example, with an inner diameter of 800–810 microns and a length of 2.5 mm. Cladding guide hole 6, formed continuous to core guide hole 5, allows cladding 3, extending from core 2 of optical fiber 1, to be tightly inserted therein. Cladding guide hole 6 can be formed, for example, with an inner diameter of 127–129 microns and a length of 5.0 mm.

A fitting section 7, formed at an intermediate position along the longitudinal axis of ferrule 4, is fitted to a fitting hole on an optical connector (not shown in the figures) in a manner that prevents rotation relative to each other. Fitting section 7 is preferably formed with a hexagonal outer shape. Ferrule 4 is formed with a first cylindrical section 8, to the right of fitting section 7, and a second cylindrical section 9, to the left of fitting section 7. First cylindrical section 8, having a smaller diameter than fitting section 7, is slightly shorter than core guide hole 5. Second cylindrical section 9, preferably having a cylindrical outer shape, is formed with a smaller diameter than that of first cylindrical section 8 and is slightly shorter than cladding guide hole 6.

Referring to FIG. 13, there is shown the end of optical fiber 1 mounted on and supported by ferrule 4. Cladding 3 of optical fiber 1 is tightly inserted in cladding guide hole 6. Core 2 of optical fiber 1 is tightly inserted into core guide hole 5 and adhesed, thus securing core 2. Ferrule 4 is formed as an integral composite structure with core guide hole 5 and cladding guide hole 6, arranged concentrically in series, and with fitting section 7, formed at an intermediate position along the longitudinal axis. Thus, the processing precision for core guide hole 5, cladding guide hole 6, fitting section 7, and the like, are improved while the defect rate is reduced. Also, production costs are reduced significantly.

Referring to FIGS. 2 through 12, a method for making ferrule 4, described above, will be described. The description of this embodiment below will also include descriptions of the two-layer clad pipe and method for making the same according to the present invention.

First, in a first step, outer pipe 10 (see FIG. 2) is formed by drawing out material such as stainless steel (SUS 303) to a length of 1–2 m and an outer diameter of 7.0–8.0 mm. Outer pipe 10 is formed with an axial hole 11, at the center, having a diameter (e.g., 5.0 mm) that is larger than that of inner pipe 12. During the drawing process, a hexagonal die and plug, suited for forming outer pipe 10, are mounted in the drawing device, and outer pipe 10 is drawn using these. Since outer pipe 10 will ultimately be cut, outer pipe 10 is formed using SUS 303 steel, which is a metal that is easy to cut.

Figure 3:
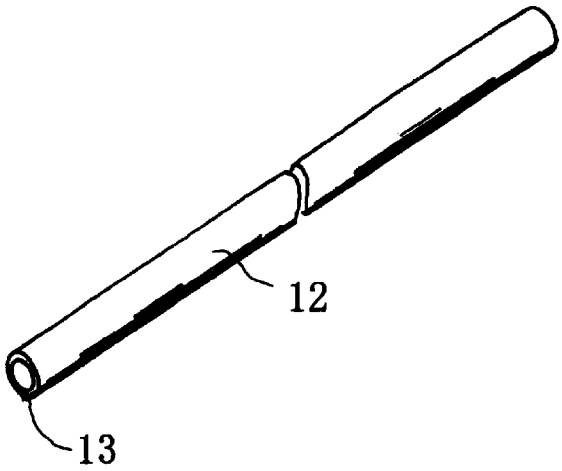
FIG. 3 is a perspective drawing of an inner pipe.

Also in this first step, inner pipe 12, as shown in FIG. 3, is formed by drawing in a similar manner as described above. Inner pipe 12 is formed so that it can be inserted into axial hole 11 of outer pipe 10. Inner pipe 12 is also formed with an axial hole 13 (e.g., 2.0 mm diameter). The outer diameter of inner pipe 12 can be, for example 4.0 mm, and is formed from a metal such as SUS 304. During the drawing process, a die and plug suited for forming inner pipe 12 are mounted in the drawing device, and inner pipe 12 is drawn using these.

Figure 4:
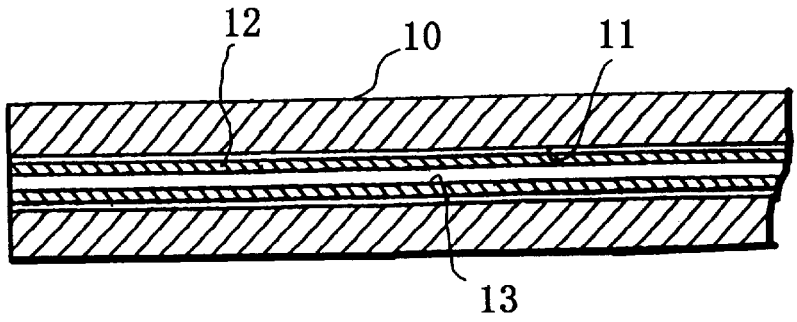
FIG. 4 is a cross-section drawing showing an inner pipe inserted in an outer pipe.
Figure 5:
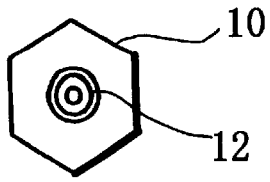
FIG. 5 is a side-view drawing of the outer pipe and the inner pipe from FIG. 4.
Figure 6:
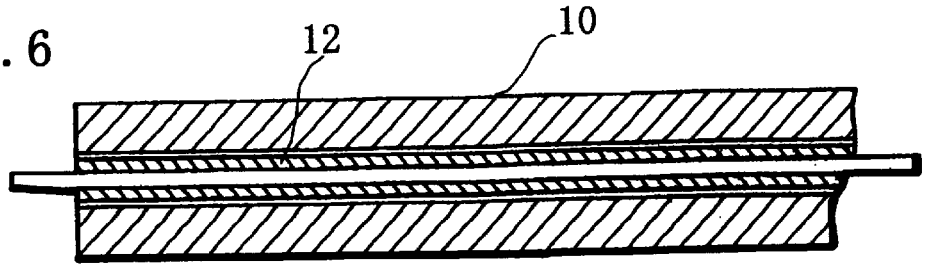
FIG. 6 is a cross-section drawing showing a core inserted into an inner pipe, which is inserted into an outer pipe.
Figure 7:
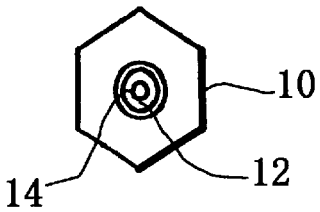
FIG. 7 is a side-view drawing of the outer pipe, the inner pipe, and the core from FIG. 6.

Referring to FIGS. 4 and 5, in the second step, inner pipe 12 is inserted into axial hole 11 of outer pipe 10. Referring now to FIGS. 6 and 7, a metal core 14 is inserted into axial hole 13 of inner pipe 12. Metal core 14 is formed from a metal that is harder than inner pipe 12. In this embodiment of the present invention, metal core 14 is a piano wire having a diameter of 127–129 microns. A predetermined releasing agent (a calcium fluid, a surfactant, or a lubricant) is applied to the surface of metal core 14 before it is inserted into axial hole 13 of inner pipe 12.

Next, in the third step, outer pipe 10 and inner pipe 12, in which metal core 14 is inserted, are set up in a drawing device. A predetermined hexagonal die is used to draw inner pipe 12 and outer pipe 10 while applying compression (cold drawing or hot drawing). As a result, inner pipe 12 is pressed tightly against the outer perimeter surface of metal core 14, and outer pipe 10 is pressed tightly against the outer perimeter surface of inner pipe 12. If the processing rate of this operation is high, the drawing operation is repeated multiple times.

Figure 8:
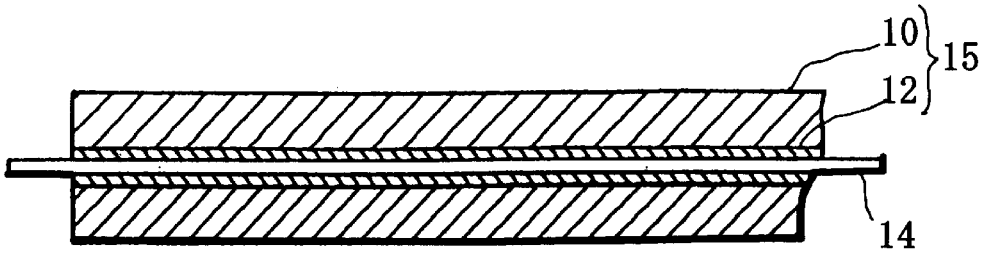
FIG. 8 is a cross-section drawing of a two-layer clad pipe and a metal core.
Figure 9:
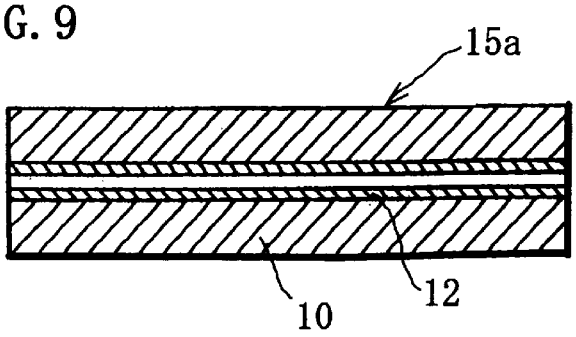
FIG. 9 is a cross-section drawing of a ferrule blank.
Figure 10:
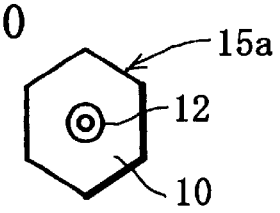
FIG. 10 is a side-view drawing of a ferrule blank.

Referring to FIG. 8, a two-layer clad pipe 15 and metal core 14 are formed as shown when the drawing operation is completed.

A piano wire harder than inner pipe 12 is used for metal core 14, but the present invention is not restricted to this construction. Other wire material can be used as long as it is harder than inner pipe 12, e.g., titanium alloy wire or various steel alloy wires.

Next, in the fourth step, metal core 14 is pulled out from two-layer clad pipe 15 to form cladding guide hole 6, having a diameter of 127–129 microns. Two-layer clad pipe 15 is cut to a predetermined length (e.g., 10–12 mm) to form a ferrule blank 15*a*.

Referring to FIGS. 11 and 12, in the fifth step, one end of cladding guide hole 6 is bored to form core guide hole 5 having a diameter larger than that of cladding guide hole 6. Also, one end of ferrule blank 15*a* is cut to form first cylindrical section 8 with an appropriate length, and the other end of ferrule blank 15*a* is cut to form second cylindrical section 9 with an appropriate length. Fitting section 7 is formed with a hexagonal shape and a predetermined length at an intermediate position along the longitudinal axis of ferrule 4. This results in composite ferrule 4.

Referring to FIG. 13, in the sixth step, cladding 3 and core 2 of optical fiber 1 are inserted into core guide hole 5 of composite ferrule 4. Cladding 3 is fitted tightly into cladding guide hole 6 while core 2 is fitted tightly into core guide hole 5. Core 2 is adhesed to core guide hole 5, and the end of optical fiber 1 is secured to ferrule 4. Then, when ferrule 4 is to be mounted to an optical connector, fitting section 7 is fitted to the fitting hole of the optical connector in a manner preventing rotation.

With the method for making composite ferrules described above, inner pipe 12 is inserted into axial hole 11 of outer pipe 10. Metal core 14 is inserted into axial hole 13 of inner pipe 12. This structure is then drawn out using a hexagonal die to form two-layer clad pipe 15. As a result, cladding guide hole 6 of ferrule 4 is formed with a small diameter using a simple method not involving cutting. Also, the drawing operation does not require a plug, leading to a greater degree of freedom in shaping. Thus, a composite ferrule 4, formed from a high-quality stainless steel, has low production error margins and is formed at less cost compared to conventional ferrules formed from two elements. This method also significantly reduces defects generated during production.

In the first step described above, outer pipe 10 is formed with a hexagonal outer shape. This simplifies the die structure used to compress and draw inner pipe 12 and outer pipe 10 while also providing a stable and efficient drawing operation.

Also, two-layer clad pipe 15 described above forms inner pipe 12 with SUS 304, which is highly malleable, and forms outer pipe 10 with SUS 303, which is easy to cut. Thus, the outer perimeter of outer pipe 10 is cut easily during the cutting operation. Furthermore, the hexagonal outer shape of two-layer clad pipe 15 can be used effectively to form hexagonal fitting section 7 to fit the fitting hole of the optical connector in a manner that prevents rotation.

The following is a description of alternative embodiments in which partial changes are made to the embodiment described above.

1) The metal used for outer pipe 10 and inner pipe 12 does not have to be stainless steel. Aluminum alloy, Duralumin, magnesium alloy, titanium, titanium alloy, and copper alloys, such as brass and phosphor bronze, can be instead. Also, the outer shape described above for fitting section 7 of ferrule 4 is just an example, and different shapes can be used to suit the application in which the optical connector is used.

2) Two-layer clad pipe 15, described above, is a pipe for making composite ferrule 4 in this embodiment. However, by selecting the metals used in outer pipe 10 and inner pipe 12 appropriately, the inner surface and the outer surface of pipe 15 can be formed with different corrosion resistance, strength, conductivity, magnetic properties, wear resistance, heat resistance, ease of cutting, specific density, and the like. This allows the pipe to be used in various applications other than as a base for ferrule 4. More specifically, the pipe can be used as a base for pipes having different sizes and structures for carrying different types of fluid, pipes serving as structural material, pipes used to produce different mechanical parts, pipes used to produce different precision devices, and the like.

Thus, the following characteristics of the two-layer clad pipe can be adjusted to suit the application: the diameter, cross-section shape (circular or non-circular irregular shape), and thickness of inner pipe 12; the cross-section shape (circular or non-circular irregular shape) of axial hole 13; the diameter, the cross-section shape (circular or non-circular irregular shape), and thickness of outer pipe 10; and the cross-section shape (circular or non-circular irregular shape) of axial hole 11. The diameter, cross-section shape (circular or non-circular irregular shape), and material of metal core 14 are also selected for the application.

Referring to FIGS. 14 through 17, another embodiment will be described.

Figure 14:
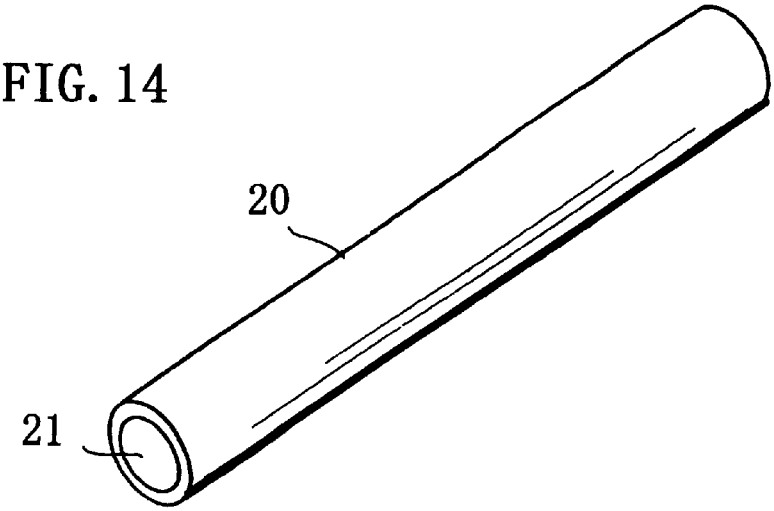
FIG. 14 is a perspective drawing of an outer pipe according to another embodiment.
Figure 15:
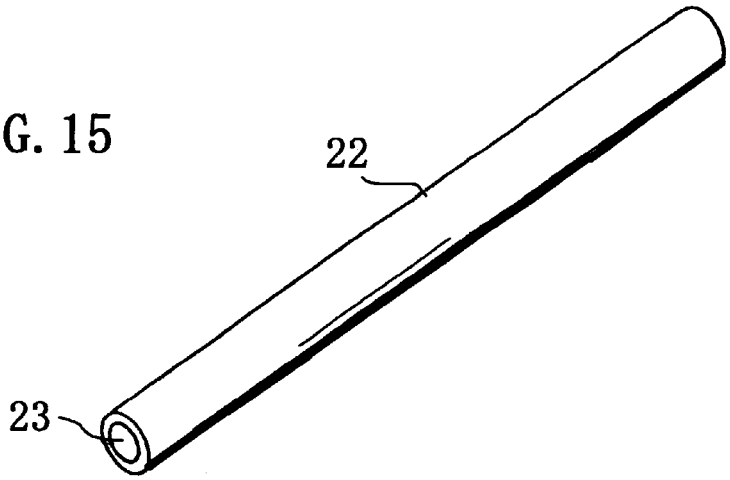
FIG. 15 is a perspective drawing of an inner pipe according to another embodiment.

This embodiment relates to a technology for producing a two-layer clad pipe without the use of metal core 14. Referring to FIG. 14, in the first step, a metal outer pipe 20 is formed by drawing. Referring to FIG. 15, an inner pipe 22 is formed by drawing a metal different from the metal used in outer pipe 20. Inner pipe 22 is formed as a pipe with an outer diameter that allows it to be inserted into an axial hole 21 of outer pipe 20. The metals used to form outer pipe 20 and inner pipe 22 are selected according to the application of this two-layer clad pipe. The selected metals must be capable of being shaped by drawing.

The metals used for outer pipe 20 and inner pipe 22 can be selected from: different types of steel such as standard steel and stainless steel, aluminum-based metals such as aluminum and aluminum alloys, magnesium-based metals, copper-based metals such as copper and alloys thereof, titanium-based metals, nickel-based metals, and the like. The following characteristics of the two-layer clad pipe can be adjusted to suit the application: the diameter, cross-section shape (circular or non-circular irregular shape), and thickness of outer pipe 20; the cross-section shape (circular or non-circular irregular shape) of axial hole 21; the diameter, cross-section shape (circular or non-circular irregular shape), and thickness of inner pipe 22; and the cross-section shape (circular or non-circular irregular shape) of axial hole 23.

Figure 16:
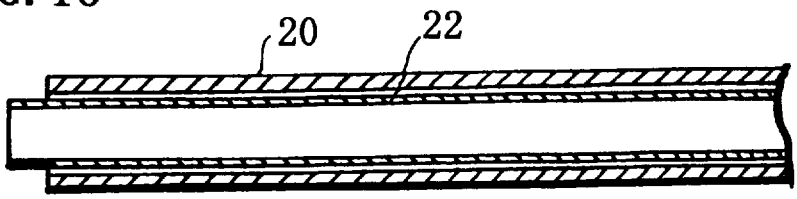
FIG. 16 is a cross-section drawing showing an inner pipe inserted into an outer pipe.

Referring to FIG. 16, in the second step, inner pipe 22 is inserted into outer pipe 20. The insertion can be performed with almost no space between the pipes or with space between the pipes.

Figure 17:
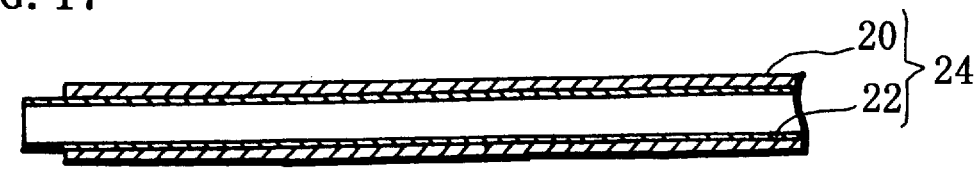
FIG. 17 is a cross-section drawing of a two-layer clad pipe.
Figure 18:
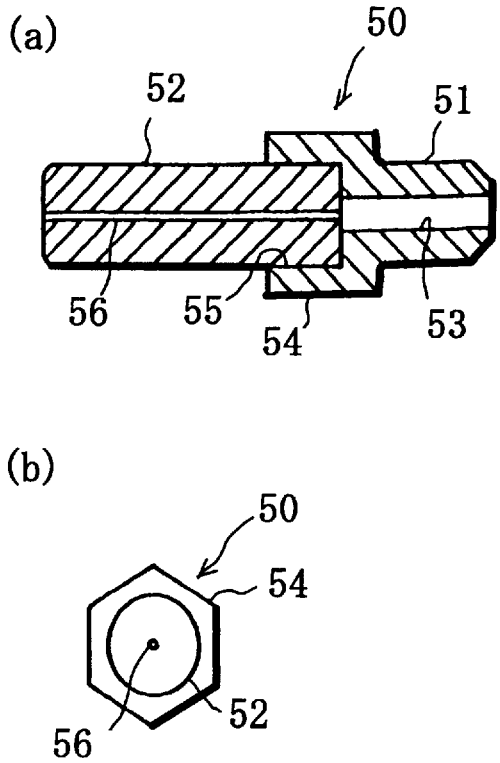
FIG. 18 (*a*) is a cross-section drawing of a conventional connection ferrule.

Referring to FIG. 17, in the third step, drawing is performed on outer pipe 20 and inner pipe 22, with inner pipe 22 inserted in outer pipe 20. This causes outer pipe 20 to press tightly against the outer perimeter surface of inner pipe 22. During the drawing process, a die and plug having predetermined shapes and dimensions are set up in the drawing device. Outer pipe 20 and inner pipe 22 are fed into the drawing device so that pipes 20 and 22 are compressed while being drawn. Thus, inner pipe 22 and outer pipe 20 are compressed radially inward, and a two-layer clad pipe 24 is formed.

Two-layer clad pipe 24 can be formed so that the inner surface and the outer surface of pipe 24 have different corrosion resistance, strength, conductivity, magnetism, wear resistance, heat characteristics, ease of cutting, specific density, and the like. This allows the pipe to be used as a base for pipes having different sizes and structures for carrying different types of fluid, pipes serving as structural material, pipes used to produce different mechanical parts, pipes used to produce different precision devices, and the like. For example, to provide a two-layer clad pipe through which corrosive fluid can flow, the inner pipe can be formed from stainless steel and the outer pipe can be formed from standard steel.

Referring to FIGS. 14 through 17, outer pipe 20 and inner pipe 22 are shown with circular cross sections. However, the cross-section shapes of outer pipe 20 and inner pipe 22 and the cross-section shape of two-layer clad pipe 24 do not have to be circular and can be other irregular, non-circular shapes.

Next, a method for forming a small-diameter hole in a rod made from an easily drawn metal will be described. Referring to FIG. 3, inner pipe 12 is formed from a solid steel rod (not shown in the figure).

Figure 2:
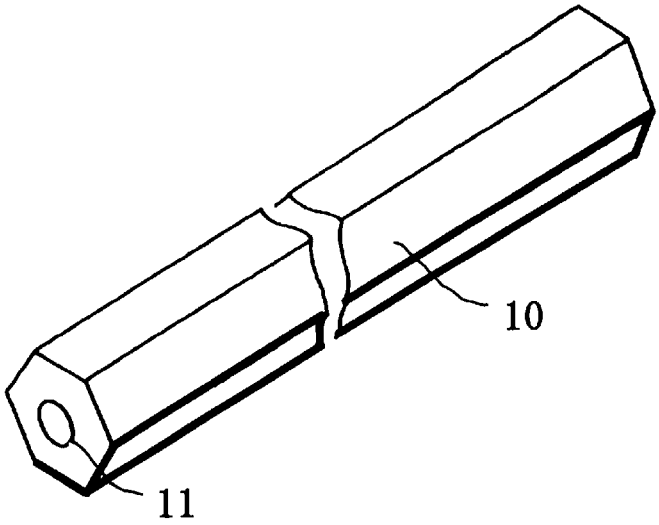
FIG. 2 is a perspective drawing of an outer pipe.

Now referring to FIG. 2, this steel rod is inserted into axial hole 11 of outer pipe 10. Drawing is then performed so that outer pipe 10 tightly presses against the outer perimeter surface of the steel rod. Then, a hole having the same diameter as the steel rod can be formed in outer pipe 10 by pulling out the steel rod from outer pipe 10.

The outer shape of outer pipe 10 can be non-hexagonal, e.g., triangular or polygonal. The cross-section shape of the steel rod does not have to be circular and can be triangular, polygonal, elliptical, or the like. The metal used in outer pipe 10 is as described in the embodiment and alternative embodiments above.

By using a small-diameter piano wire or other small-diameter hard metal having good tensile strength in place of the steel rod described above, a small-diameter hole of less than a 100 microns is formed.

The embodiments described above present only two examples. Various changes to these embodiments can be made by a person skilled in the art without departing from the spirit of the present invention.

The advantages provided by the present invention, as described in the claims, will be presented.

A two-layer clad pipe according to the present invention includes a metal inner pipe and an outer pipe outwardly fitted tightly against an outer perimeter surface of the inner pipe. The outer pipe is formed from a metal different from a metal used to form the inner pipe. Since the inner pipe and the outer pipe are formed from different metals, the metals used for the inner pipe and the outer pipe can be selected according to the functions required for the inner surface and the outer surface of the pipe.

For example, with a two-layer clad pipe with an inner pipe formed from stainless steel and an outer pipe formed from standard steel, the inner surface will have good corrosion resistance, thus making the pipe suitable for various applications. With a two-layer clad pipe with an inner pipe formed from aluminum and an outer pipe formed as a relatively thin stainless steel pipe, the resulting pipe will be light and will have an outer surface with good corrosion resistance, thus making the pipe suitable for various applications.

If both the inner pipe and the outer pipe are made by drawing, both pipes will be high-quality pipes with no seams. This will provide a high-quality two-layer clad pipe with no seams. Also, using a metal that is easily cut for the outer pipe will be useful when cutting the outer pipe.

In a method for making a two-layer clad pipe according to the present invention, an inner pipe and an outer pipe are produced by drawing. The inner pipe is inserted into the outer pipe, and a metal core is inserted into the inner pipe. The outer pipe and the inner pipe with the inserted metal core are drawn so that the inner pipe is pressed tightly against the metal core and the outer pipe is pressed tightly against an outer perimeter surface of the inner pipe. Finally, the metal core is pulled out from the inner pipe. This allows easy production of two-layer clad pipes in which the inner pipe and outer pipes are formed from different metals.

Since the drawing operation is performed with the metal core inserted, the plug of the drawing device can be eliminated and shaping can be performed with just a die. This increases the degree of freedom in shaping, and allows two-layer clad pipes to be produced with various cross-section shapes. Since the inner pipe is pressed tightly against the outer pipe and the inner pipe is pressed tightly against the metal core, the inner pipe and the outer pipe can be pressed sufficiently tightly together, thus providing a high-quality two-layer clad pipe.

Since the metal core is pulled out after the drawing operation, the metal core allows a hole having the same cross-section shape as the metal core to be formed in a precise manner in the two-layer clad pipe. The cross-section shape of the metal core does not have to be circular, and other irregular, non-circular shapes can be used. The thickness (diameter) of the metal core can be selected freely within the restriction imposed by the diameter of the inner pipe. Thus, for example, a small-diameter hole can be formed using a metal core with a diameter of approximately 100 microns.

If the metal core has a circular cross-section shape, a hole with a circular cross-section shape can be formed in the two-layer clad pipe. Alternatively, if the metal core has an irregular, non-circular cross-section shape, the two-layer clad pipe can be formed with a hole having an irregular cross-section shape.

In another method for making a two-layer clad pipe according to the present invention, an inner pipe and an outer pipe are produced from different metals by drawing. The inner pipe is inserted into the outer pipe. The outer pipe and the inner pipe with the inner pipe inserted into the outer pipe are drawn so that the outer pipe is pressed tightly against an outer perimeter surface of the inner pipe. This allows easy production of two-layer clad pipes in which the inner pipe and outer pipes are formed from different metals.

Since both the inner pipe and the outer pipe are produced by drawing, the cross-section shape of the two-layer clad pipe, the thicknesses of the inner pipe and the outer pipe and the like can be selected freely. Both the inner pipe and the outer pipe will be high-quality pipes with no seams. Since the outer pipe is pressed tightly against the inner pipe by the drawing operation, a high-quality two-layer clad pipe is provided. Since a metal core is not used, costs involved in inserting, storing, and transporting the metal core can be eliminated.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A two-layer clad pipe comprising:

a metal inner pipe; and an outer pipe inwardly fitted tightly against an outer perimeter surface of said inner pipe, said outer pipe being formed from a metal different from a metal used to form said inner pipe;

wherein said metal used to form said inner pipe or said outer pipe is selected from the group consisting of: stainless steel, aluminum, aluminum alloys, magnesium-based metals, copper, copper alloys, titanium-based metals, and nickel-based metals; and wherein said inner layer is cut to a length and said outer layer is cut to a length equal to said length of said inner layer at at least one end of said two-layer clad pipe; and wherein a surface of said outer pipe has greater corrosion-resistance than a surface of said inner pipe.

2. A two-layer clad pipe comprising:

a metal inner pipe; and an outer pipe inwardly fitted tightly against an outer perimeter surface of said inner pipe, said outer pipe being formed from a metal different from a metal used to form said inner pipe;

wherein said metal used to form said inner pipe or said outer pipe is selected from the group consisting of: stainless steel, aluminum, aluminum alloys, magnesium-based metals, copper, copper alloys, titanium-based metals, and nickel-based metals; and wherein said inner layer is cut to a length and said outer layer is cut to a length equal to said length of said inner layer at at least one end of said two-layer clad pipe; and wherein no more than one end of said two-layer clad pipe is ferruled.

* * * * *